US008915358B2

(12) United States Patent
Johnson et al.

(10) Patent No.: US 8,915,358 B2
(45) Date of Patent: Dec. 23, 2014

(54) WET WIPES DISPENSER WITH LID POSITIONING FEATURE

(71) Applicant: Kimberly-Clark Worldwide, Inc., Neenah, WI (US)

(72) Inventors: Kroy D. Johnson, Neenah, WI (US); Linda J. Van Dyke, Neenah, WI (US); Robert Schlaupitz, New London, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 37 days.

(21) Appl. No.: 13/853,502

(22) Filed: Mar. 29, 2013

(65) Prior Publication Data

US 2014/0291191 A1 Oct. 2, 2014

(51) Int. Cl.

*B65D 43/24* (2006.01)
*B65D 81/24* (2006.01)
*B65D 43/18* (2006.01)

(52) U.S. Cl.

CPC ..... *B65D 43/18* (2013.01)
USPC ..... 206/210; 206/494; 220/264; 220/838; 220/254.5

(58) Field of Classification Search

USPC ..... 206/205, 210, 438, 440, 494, 812; 220/254, 260, 262, 263, 264, 315, 826, 220/831, 838, 840, 842

See application file for complete search history.

(56) References Cited

U.S. PATENT DOCUMENTS 1,883,852 A 10/1932 Medoff
1,910,522 A 5/1933 Coryell
1,953,887 A 4/1934 Medoff
2,264,300 A 12/1941 Davies
3,405,836 A 10/1968 Regis, Jr.
3,587,944 A 6/1971 Pehr
3,780,908 A 12/1973 Fitzpatrick et al.
3,967,756 A 7/1976 Barish
D244,583 S 6/1977 Barish
4,061,226 A 12/1977 Essen
D249,470 S 9/1978 Kohn
4,156,493 A 5/1979 Julius
4,185,754 A 1/1980 Julius
D261,826 S 11/1981 Webb
4,553,665 A 11/1985 Weick et al.

(Continued)

FOREIGN PATENT DOCUMENTS

CA 2 218 649 C 10/1997
DE 7332041 U 3/1974

(Continued)

*Primary Examiner* — Jacob K Ackun

(74) *Attorney, Agent, or Firm* — Kimberly-Clark Worldwide, Inc.

(57) ABSTRACT

A moist wipes dispenser has a top attached to a bottom along a hinge. The top is adapted to pivot about the hinge's axis of rotation. The top is adapted to assume a closed position and a dispensing position. In one embodiment, the top can assume a warning position adapted to warn a user that the top is not shut. The top is urged to the warning position if the top is angularly disposed in a red zone that extends between the closed position and the warning position. The warning position is angularly displaced from the closed position by at least five degrees. In another embodiment, the hinge includes a pin integrally molded with the top or bottom, and an open knuckle integrally molded with the other of the top and bottom. The hinge is adapted to urge the top into closed and dispensing positions in selected angular ranges.

20 Claims, 17 Drawing Sheets

(56) References Cited

U.S. PATENT DOCUMENTS

| | | | | |
|---|---|---|---|---|
| 4,684,017 | A | 8/1987 | Watanabe et al. | |
| 4,735,317 | A | 4/1988 | Sussman et al. | |
| 4,739,900 | A | 4/1988 | Borst | |
| D295,830 | S | 5/1988 | Holly | |
| D295,961 | S | 5/1988 | Holly | |
| 4,854,473 | A | 8/1989 | Dubach | |
| 4,971,220 | A | 11/1990 | Kaufman et al. | |
| 5,040,680 | A | 8/1991 | Wilson et al. | |
| 5,145,091 | A | 9/1992 | Meyers | |
| D365,755 | S | 1/1996 | Kanfer et al. | |
| D367,609 | S | 3/1996 | Frank et al. | |
| 5,531,325 | A | 7/1996 | Deflander et al. | |
| 5,542,567 | A | 8/1996 | Julius | |
| 5,542,568 | A | 8/1996 | Julius | |
| 5,573,132 | A | 11/1996 | Kanfer et al. | |
| 5,582,294 | A | 12/1996 | Yamada | |
| 5,647,506 | A | 7/1997 | Julius | |
| 5,699,912 | A | 12/1997 | Ishikawa et al. | |
| 5,729,955 | A | 3/1998 | Yamada | |
| D396,329 | S | 7/1998 | Litton | |
| 5,791,465 | A | 8/1998 | Niki et al. | |
| D398,079 | S | 9/1998 | Denison | |
| 5,938,013 | A * | 8/1999 | Palumbo et al. | 206/210 |
| 5,980,931 | A | 11/1999 | Fowler et al. | |
| 5,996,797 | A * | 12/1999 | Flaig | 206/494 |
| 6,006,940 | A | 12/1999 | Lundin | |
| D421,901 | S | 3/2000 | Hill | |
| D421,902 | S | 3/2000 | Hill | |
| 6,092,690 | A * | 7/2000 | Bitowft et al. | 220/831 |
| 6,102,247 | A | 8/2000 | Crawford | |
| 6,121,165 | A | 9/2000 | Mackey et al. | |
| 6,206,221 | B1 | 3/2001 | Bando et al. | |
| 6,213,300 | B1 | 4/2001 | Flaig et al. | |
| D442,081 | S | 5/2001 | Paul | |
| D443,450 | S | 6/2001 | Ruhotas et al. | |
| D443,508 | S | 6/2001 | Braaten et al. | |
| D446,012 | S | 8/2001 | Ashiwa et al. | |
| D450,960 | S | 11/2001 | Boyea et al. | |
| D454,015 | S | 3/2002 | Okin et al. | |
| 6,394,298 | B1 | 5/2002 | Zaidman | |
| 6,412,634 | B1 | 7/2002 | Telesca et al. | |
| D461,403 | S | 8/2002 | Chomik et al. | |
| 6,474,493 | B1 | 11/2002 | Lacout | |
| 6,499,626 | B1 | 12/2002 | Julius | |
| 6,520,331 | B2 | 2/2003 | Okin et al. | |
| 6,523,690 | B1 | 2/2003 | Buck et al. | |
| D471,440 | S | 3/2003 | Sams et al. | |
| D473,740 | S | 4/2003 | Ruhotas et al. | |
| 6,550,634 | B1 | 4/2003 | Alegre De Miquel et al. | |
| 6,554,134 | B1 | 4/2003 | Guibert | |
| 6,592,004 | B2 | 7/2003 | Huang et al. | |
| 6,604,628 | B1 | 8/2003 | Tanaka et al. | |
| D479,419 | S | 9/2003 | White et al. | |
| D479,420 | S | 9/2003 | White et al. | |
| 6,655,544 | B1 | 12/2003 | Tanaka et al. | |
| D485,461 | S | 1/2004 | Sams et al. | |
| 6,702,109 | B1 | 3/2004 | Tabuchi | |
| 6,729,498 | B2 * | 5/2004 | Yelton et al. | 221/63 |
| 6,766,919 | B2 | 7/2004 | Huang et al. | |
| D495,545 | S | 9/2004 | Niehues | |
| D495,910 | S | 9/2004 | Zaidman | |
| 6,786,447 | B2 | 9/2004 | Geib et al. | |
| D506,132 | S | 6/2005 | De Vries | |
| 6,902,077 | B1 | 6/2005 | Tack et al. | |
| 6,910,579 | B2 | 6/2005 | Reinke et al. | |
| 7,073,684 | B2 | 7/2006 | Decker et al. | |
| 7,232,040 | B2 | 6/2007 | Decker et al. | |
| 7,614,519 | B2 | 11/2009 | Krauth et al. | |
| 7,621,401 | B2 | 11/2009 | Alegre et al. | |
| 2002/0017522 | A1 | 2/2002 | Bando et al. | |
| 2002/0117507 | A1 | 8/2002 | Doerfler et al. | |
| 2002/0162765 | A1 * | 11/2002 | Okin et al. | 206/494 |
| 2003/0098313 | A1 | 5/2003 | Cheng | |
| 2003/0106897 | A1 | 6/2003 | Zethoff et al. | |
| 2003/0159403 | A1 | 8/2003 | Verespej et al. | |
| 2004/0099545 | A1 | 5/2004 | De Vries | |
| 2005/0011906 | A1 | 1/2005 | Buck et al. | |
| 2005/0092764 | A1 | 5/2005 | Chasid et al. | |
| 2005/0092765 | A1 | 5/2005 | Chasid et al. | |
| 2005/0211717 | A1 | 9/2005 | Decker et al. | |
| 2005/0211718 | A1 | 9/2005 | Decker et al. | |
| 2006/0054517 | A1 | 3/2006 | Albert | |
| 2007/0235466 | A1 | 10/2007 | Fulscher et al. | |
| 2007/0246390 | A1 * | 10/2007 | Alexander | 206/494 |
| 2009/0200330 | A1 | 8/2009 | Giraud | |

FOREIGN PATENT DOCUMENTS

| | | | |
|---|---|---|---|
| DE | 200 00 604 | U1 | 4/2000 |
| EP | 0 760 343 | A1 | 3/1997 |
| EP | 0 832 823 | A2 | 4/1998 |
| EP | 0 738 667 | B1 | 7/1999 |
| EP | 0 930 243 | A1 | 7/1999 |
| EP | 0 955 247 | A1 | 11/1999 |
| EP | 1 024 090 | A1 | 8/2000 |
| EP | 1 258 428 | A1 | 11/2002 |
| GB | 1 449 265 | A | 9/1976 |
| GB | 1 476 303 | A | 6/1977 |
| JP | 06-263174 | A | 9/1994 |
| JP | 08-072949 | A | 3/1996 |
| JP | 08-080980 | A | 3/1996 |
| JP | 08-091454 | A | 4/1996 |
| JP | 09-156676 | A | 6/1997 |
| JP | 09-216672 | A | 8/1997 |
| JP | 10-329878 | A | 12/1998 |
| JP | 11-342091 | A | 12/1999 |
| JP | 11-349066 | A | 12/1999 |
| JP | 2000-072160 | A | 3/2000 |
| JP | 2000-072191 | A | 3/2000 |
| JP | 2000-102493 | A | 4/2000 |
| JP | 2000-211680 | A | 8/2000 |
| JP | 2001-145582 | A | 5/2001 |
| JP | 2001-225880 | A | 8/2001 |
| JP | 2001-245816 | A | 9/2001 |
| JP | 2001-275876 | A | 10/2001 |
| JP | 2001-294254 | A | 10/2001 |
| JP | 2001-301850 | A | 10/2001 |
| JP | 2002-104458 | A | 4/2002 |
| JP | 2002-302170 | A | 10/2002 |
| JP | 2002-337959 | A | 11/2002 |
| JP | 2006-062706 | A | 3/2006 |
| WO | WO 93/18988 | A1 | 9/1993 |
| WO | WO 96/33111 | A1 | 10/1996 |
| WO | WO 96/37138 | A1 | 11/1996 |
| WO | WO 97/36527 | A1 | 10/1997 |
| WO | WO 98/19933 | A1 | 5/1998 |
| WO | WO 98/19934 | A1 | 5/1998 |
| WO | WO 99/55213 | A1 | 11/1999 |
| WO | WO 00/06465 | A1 | 2/2000 |
| WO | WO 00/64755 | A2 | 11/2000 |
| WO | WO 01/83324 | A1 | 11/2001 |
| WO | WO 03/016172 | A1 | 2/2003 |
| WO | WO 03/076298 | A1 | 9/2003 |
| WO | WO 2005/023677 | A1 | 3/2005 |

* cited by examiner

WET WIPES DISPENSER WITH LID POSITIONING FEATURE

BACKGROUND

Dispensers for wet wipes and other substrates come in a wide variety of types and styles. Frequently, dispensers include lids that open to access the wipes contained therein. The lid is often held in a closed position by some restraining mechanism, such as a latch, snap, lock, or magnet. Latching or snapping the lid into the closed position often requires that a user apply a force to the lid to latch or snap it shut. Proper closing of the lid is important to prevent premature evaporation of the wetting solution with which the wipes are soaked. One common problem is that users will attempt to close the lid, but unwittingly not properly latch, lock, or otherwise completely and fully close the lid. The result is that the lid can remained slightly ajar, leading to slow but steady evaporation of the wetting solution, potential contamination of the wet wipes, or even loss of the wipes.

Also, it is desirable in some dispensers to have the lid adopt and maintain certain positions. For example, it is common in wipes dispensers to adopt a structure that urges an open lid into a fully open "dispensing" position to keep the lid out of the way when a user is pulling a wipe out of the dispenser. However, springs of various sorts have been conventionally required to create this effect, requiring the procurement and handling of a small extra component (the spring) that is generally not made of a recyclable plastic, and which introduces added complexity to commercial processes for manufacturing the dispenser.

SUMMARY

In one embodiment, a moist wipes dispenser has a top attached to a bottom along a hinge. The hinge has an axis of rotation, and the top is adapted to pivot about the axis of rotation. The top is adapted to assume a substantially vapor-impervious closed position, a dispensing position adapted to allow access to an interior of the dispenser, and a warning position adapted to warn a user that the top is not in the closed position. The warning position is angularly displaced from the closed position by at least five degrees. In the closed position, the top is restrained so as to be sealingly engaged with the bottom. A force must be applied to the top by a user to urge the top to the closed position. The dispenser is configured such that the top is urged to the warning position if the top is angularly disposed in a red zone that extends between the closed position and the warning position.

In another embodiment, a moist wipes dispenser includes a tub, a main lid, and a dispensing lid. The main lid is attached to the tub along a first hinge, and the dispensing lid is attached to either the tub or the main lid along a second hinge. The second hinge has an axis of rotation, and the dispensing lid is adapted to pivot about the axis of rotation. The dispensing lid is adapted to assume a substantially vapor-impervious closed position, a dispensing position adapted to allow access to an interior of the dispenser, and a warning position adapted to warn a user that the top is not in the closed position. The warning position is angularly displaced from the closed position by at least five degrees. In the closed position, the dispensing lid is restrained so as to be sealingly engaged with the main lid. A force must be applied to the dispensing lid by a user to urge the dispensing lid to the closed position. The dispenser is configured such that the dispensing lid is urged to the warning position if the dispensing lid is disposed in a red zone that extends angularly between the closed position and the warning position.

In yet another embodiment, a moist wipes dispenser includes a top attached to a bottom along a hinge, and the hinge has an axis of rotation. The top is adapted to pivot about the axis of rotation. The top is adapted to assume a substantially vapor-impervious closed position and a dispensing position that is adapted to allow access to an interior of the dispenser. In the closed position, the top is sealingly engaged with the bottom. The hinge comprises a pin integrally molded with one of the top and bottom, and further comprises an open knuckle integrally molded to the other of the top and bottom. The open knuckle is in clamped engagement with the pin. The pin and the knuckle are shaped to collectively urge the top (1) toward the closed position when the top is angularly displaced from the closed position by as much as 20 degrees; and (2) toward the dispensing position when the top is angularly displaced from the dispensing position by as much as 20 degrees.

BRIEF DESCRIPTION OF THE DRAWINGS

The above aspects and other features, aspects, and advantages of the present invention will become better understood with regard to the following description, claims, and accompanying drawings where:

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 1:
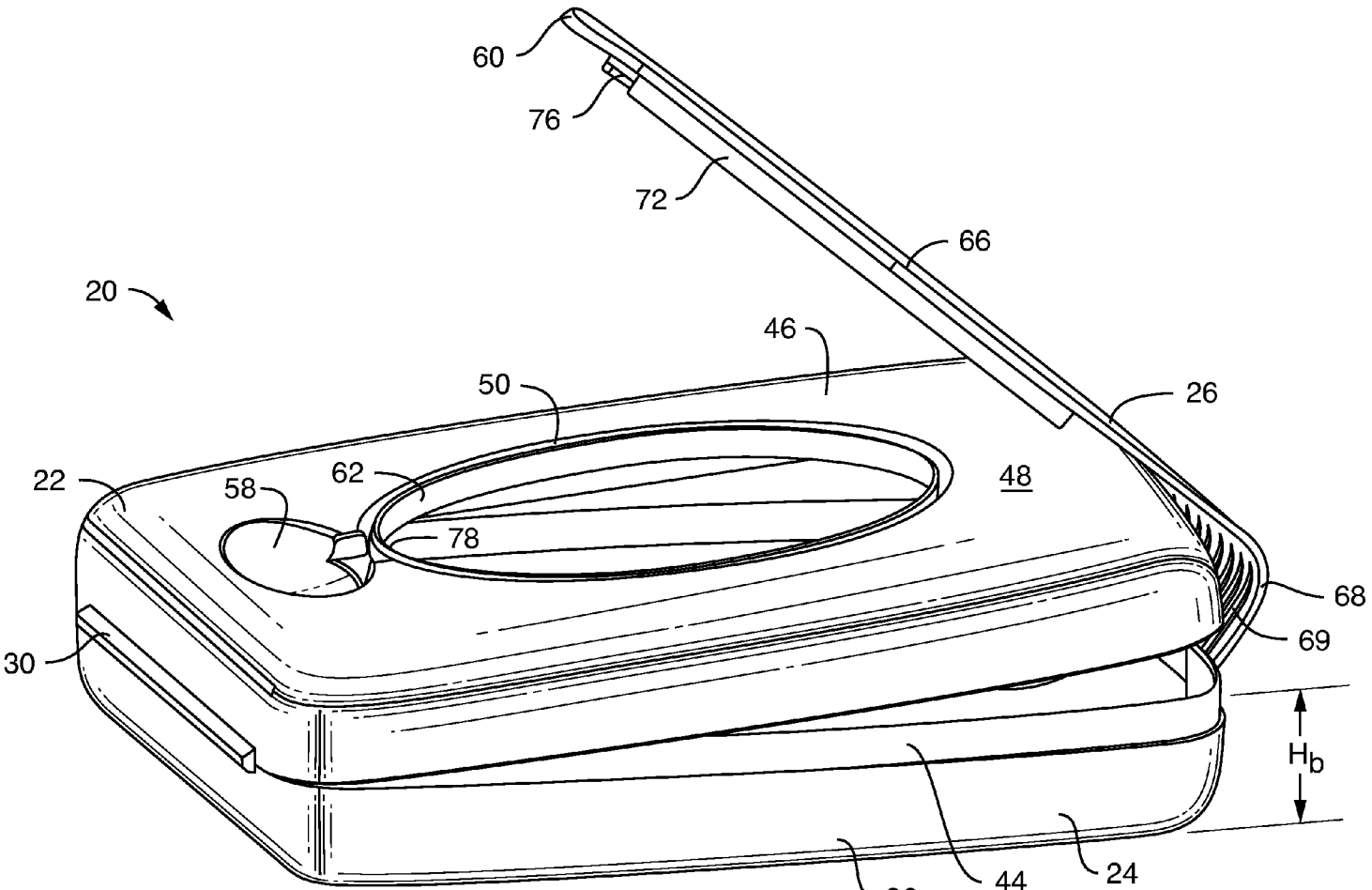
FIG. 1 illustrates a perspective view of one embodiment of a partially opened dispenser.

Referring to FIGS. 1, 2, 3, 4, 5, and 6, one embodiment of the substrate dispenser 20 is shown. The dispenser 20 can be made of suitable materials such as polyolefins, styrenics, or other semi-rigid plastics or any combination thereof. The dispenser 20 includes a top 22, a bottom 24, and a lid 26. The top 22 is attached to a first side 28 of the bottom 24 by a first hinge 30. The lid 26 is attached to a second side 32 of the bottom 24 by a second hinge 34. Since the lid 26 is hinged to the bottom 24, the lid 26 must be first opened to open the top 22 as best shown in FIG. 1. Thus, in the event that the dispenser 20 is dropped, the top 22 is less likely to open spilling the contents of the dispenser since the top 22 is restrained from opening by the lid 26 and by the bottom 24. The top 22 can be restrained from opening where it mates with the bottom 24, and the top 22 can be restrained from opening by the overlapping lid 26. Thus, two methods can be used to prevent the top from opening providing a more spill-proof dispenser. In one embodiment, the top 22 and the lid 26 were hinged on opposite sides of the bottom 24. In another embodiment, the top 22 and the lid 26 were hinged on adjacent sides of the bottom 24.

Figure 4:
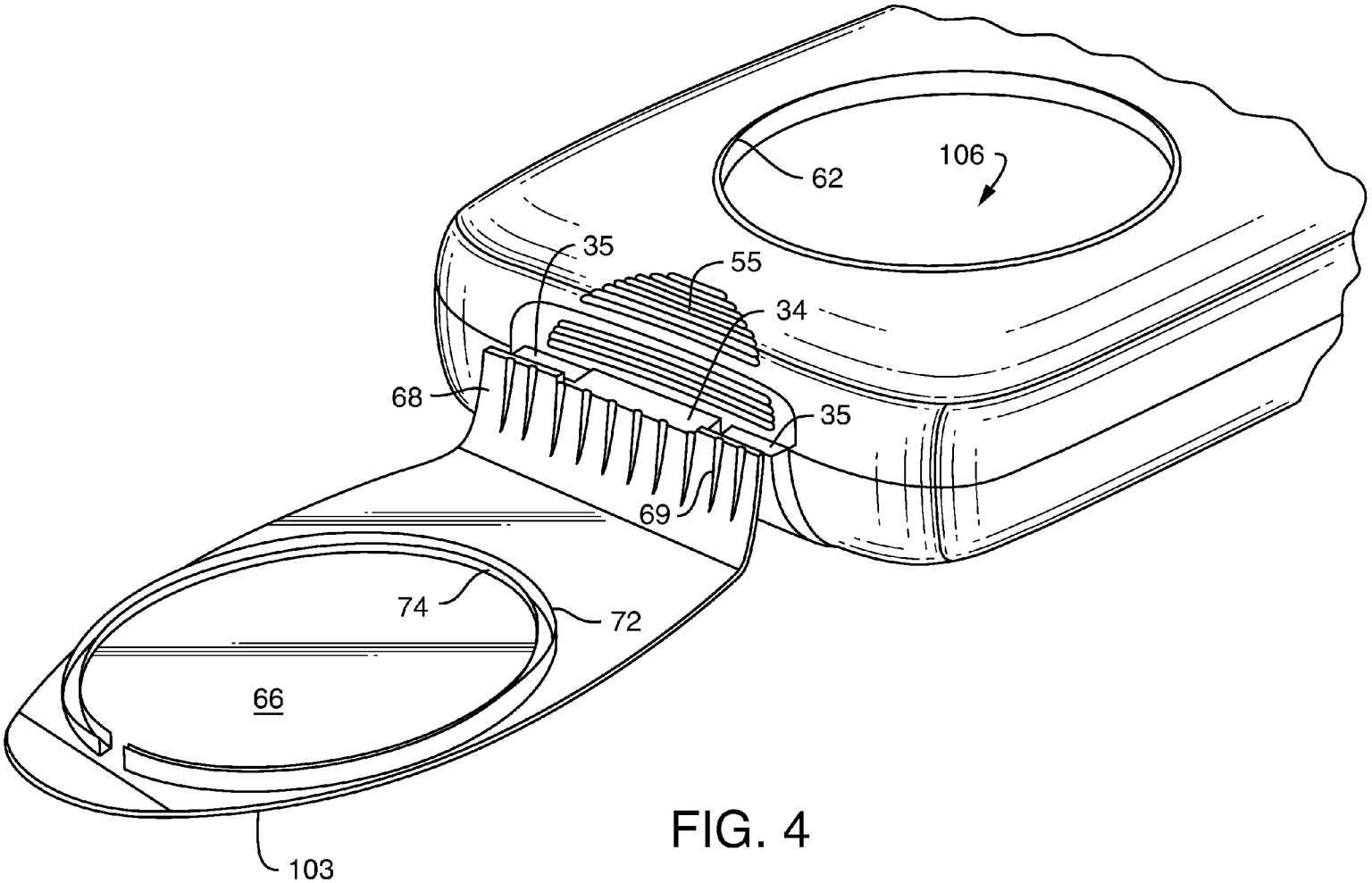
FIG. 4 illustrates a perspective view of one embodiment of the dispenser with the lid opened and the top closed.
Figure 5:
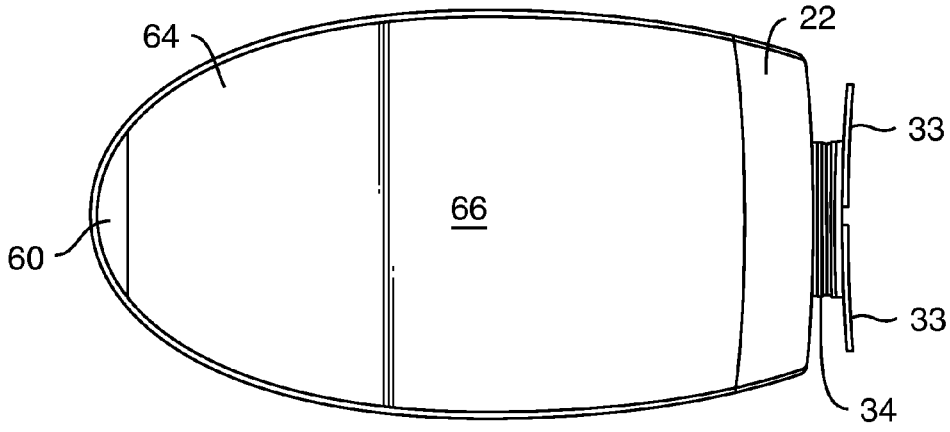
FIG. 5 illustrates a top view of one embodiment of a lid.
Figure 6:
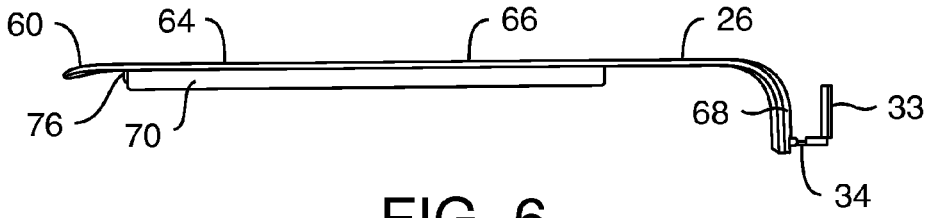
FIG. 6 illustrates a side view of one embodiment of the lid of FIG. 5.

The top 22 and lid 26 can be attached to the bottom 24 by living hinges, separate hinge pieces, formed hinges using one or more pins that fit into one or more holes, flexible straps, adhesive tape seams or any other method to hingably attach two components as known to those of skill in the art. In one embodiment, the top 22 was attached to the bottom 24 by first hinge 30, that was a living hinge. As such, the top 22 and bottom 24 can be molded as one unitary piece. In one embodiment, the lid 26 was a separate piece that was attached to the bottom 24 by one or more tabs 33 that fit into one or more slots 35 in the bottom 24 as best seen in FIGS. 4, 5, and 6. The tabs and slots can be designed such that the parts snap-fit together making removal or separation difficult. The tabs 33 can be joined to the lid 26 by the second hinge 34, which can be a living hinge. Alternatively, the top 22, bottom 24, and lid 26 can be separately molded pieces that are attached to each other, or the three pieces can be molded as an integral assembly.

In one embodiment, the bottom 24 was a tub 36 having a floor 38 and an upstanding sidewall 40. Located on an upper edge 42 of the upstanding sidewall 40 is a sealing flange 44 extending substantially along the perimeter of the upper edge 42. The tub 36 is substantially rectangular in shape, although this is not necessary, and the tub 36 can be any convenient size or shape such as square, round, polygon, etc. The edges where the upstanding sidewall 40 meet with the floor 38 can be radiused, and the corners of the rectangular sidewall 40 can also be radiused or rounded. This can make the dispenser 20 more comfortable to hold.

In various embodiments, the overall height of the bottom, Hb, can be less than, equal to, or greater than about ½ the overall height of the dispenser 20. For example, the bottom 24 can comprise most of the dispenser's overall height and the top 22 can be relatively flat. Conversely, the top 22 can comprise most of the dispensers overall height and the bottom 24 can be relatively flat. Alternatively, the top and bottom can be approximately the same height.

In various embodiments, the overall height of the bottom, Hb, can be between about 0.25" to about 2 inches, or between about 0.25" to about 1.5 inches, or between about 0.25" to about 1 inch. The overall height of the dispenser, Hd, can be between about 0.5" to about 4 inches, or between about 0.5" to about 2.5 inches, or between about 0.5" to about 1.5 inches.

In one embodiment, the top 22 was a main lid 46 allowing for access to the tub 36 and the main lid 46 included an upper surface 48 having a dispensing orifice 50 and a distending sidewall 52. With the main lid 46 opened, the tub 36 can be refilled with a plurality of wet wipes or other substrates. Located on a lower edge 54 of the distending sidewall 52 is a sealing recess 56 extending substantially along the perimeter of the lower edge 54. The sealing recess 56 and the sealing flange 44 can be sized to a slight interference fit such that the top 22 and the bottom 24 will mate together. Alternatively, the sealing recess 56 and sealing flange 44 can be sized to guide the top 22 and the bottom 24 while closing them with no interference.

Alternatively, the sealing flange 44 and/or sealing recess 56 can be modified such that the top 22 and the bottom 24 snap or removably lock together as known by those of skill in the art. For example, a bead can be located on the sealing flange 44 that snaps into a groove on the sealing recess 56. Alternatively, the sealing flange 44 can fit or mate between the sealing recess 56 and an additional flange that extends from the main lid 46 creating a groove for the sealing flange 44 to snap into. Alternatively, either the main lid 46 or the tub 36 can have one or more projections that mate with a suitable recess in the opposing part. Regardless of the specific mechanism used, it is desirable for the main lid 46 to latch, snap, or fit tightly with the tub 36 such that if the dispenser 20 is inverted and held by the tub 36 with the lid 26 opened, the main lid 46 and tub 36 do not separate or open due to the force of gravity acting on the main lid 46. The latch, snap or tight fit should be not too great so as to prevent a person from opening the main lid 46 relative to the tub 36 to refill the dispenser.

The top 22 is substantially rectangular in shape, although this is not necessary, and the top 22 can be any convenient size or shape such as square, round, polygon, etc. The edges where the distending sidewall 52 meet with the upper dispensing surface 48 can be radiused, and the corners of the rectangular distending sidewall 52 can also be radiused or rounded. This can make the dispenser 20 more comfortable to hold. The top 22 or main lid 46 can also have a surface texture 55 located opposite the first hinge 30 as best seen in FIG. 4. The surface texture, such as a series of molded lines or grooves, can assist with opening the main lid 46 to refill the tub 36.

In various embodiments, the overall height of the top, Ht, can be less than, equal to, or greater than about ½ the overall height of the dispenser 20. For example, the top 22 can comprise most of the dispenser's overall height and the bottom 24 can be relatively flat. Conversely, the bottom 24 can comprise most of the dispenser's overall height and the top 22 can be relatively flat. Alternatively, the top and bottom can be approximately the same height. In various embodiments, the overall height of the top, Ht, can be between about 0.25" to about 2 inches, or between about 0.25" to about 1 inch, or between about 0.25" to about 0.75 inch.

It can be advantageous to make the top 22 shorter than the bottom 24 since this can make it easier to refill the dispenser with fresh wet wipes. For example, if the wet wipes are packaged in a refill pouch or other flexible packaging, having the tub 36 extend to a height, Hb, greater than ½ the dispensers overall height, Hd, can help fold the seals of the refill pouch upward and out of the way to assist in closing the main lid 46 onto the tub 36. Alternately, if the bottom 24 is taller than the top 22, it can be easier to fill the tub 36 with a stack of wipes and have the stack less likely to fall out since it will be better contained by the tub. In various embodiments of the invention, the ratio of the bottom height to the dispenser's height, Hb/Hd can be between about 0.51 to about 0.9, or between about 0.53 to about 0.75, or between about 0.55 to about 0.65.

In one embodiment, the upper dispensing surface 48 of the main lid 46 included an opening recess 58 for easier access to an opening tab 60 located on the lid 26. The main lid 46 also included one or more orifice flange(s) 62 extending from the upper dispensing surface 48 for improved sealing of the dispensing orifice 50. The dispensing orifice 50 can be any shape or size. Preferably, the dispensing orifice is sized to be smaller than the lid or top dimensions to create resistance when dispensing the wet wipes and can be round, oval, or square. The dispensing orifice can be a flexible slit or opening in a rubber-like material as disclosed in U.S. Pat. Nos. 6,523,690; 6,592,004; and 6,766,919.

In one embodiment, the lid 26 was a mini-lid 64 that covered only a portion of the top 22 such as a portion of the upper surface 48 and the dispensing orifice 50. The mini-lid 64 can be hingedly attached to the upstanding sidewall 40 of the tub 36. As such, the mini-lid 64 must be first opened to open the main lid 46 as best seen in FIG. 1. Thus, in the event that the dispenser 20 is dropped, the main lid 46 is unlikely to open thereby spilling the contents of the dispenser 20. The main lid 46 is secured by both sealing flange 44 and the sealing recess 56, and by the overlapping mini-lid 64 hinged to the tub 36.

In one embodiment, the mini-lid 64 was "L" shaped having an overlapping section 66 that contacts the upper surface 48 and a pivoting extension 68. The pivoting extension 68 can be reinforced with one or more ribs 69 as known to those of skill in the art. Extending from the overlapping section 66 can be one or more dispensing flanges 70 that mate with the orifice flange 62. For example, there can be two dispensing flanges 70 such as a taller outer dispensing flange 72 and a shorter inner dispensing flange 74. The orifice flange 62 can mate between the two dispensing flanges (72, 74) when the mini-lid 64 is closed, forming a substantially air tight seal. Alternatively, other methods known to those of skill in the art can be used to form a substantially air tight seal when the mini-lid 64 is closed.

Figure 2:
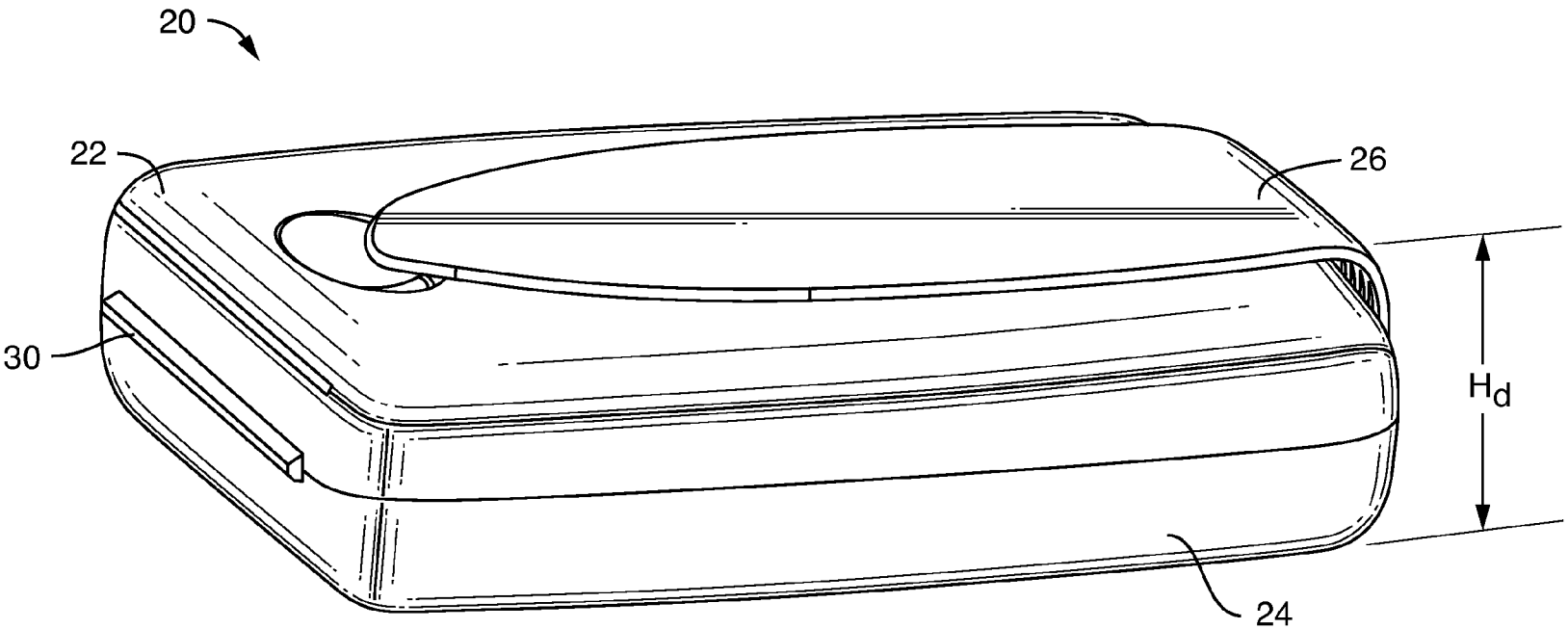
FIG. 2 illustrates a perspective view of one embodiment of a closed dispenser.
Figure 3:
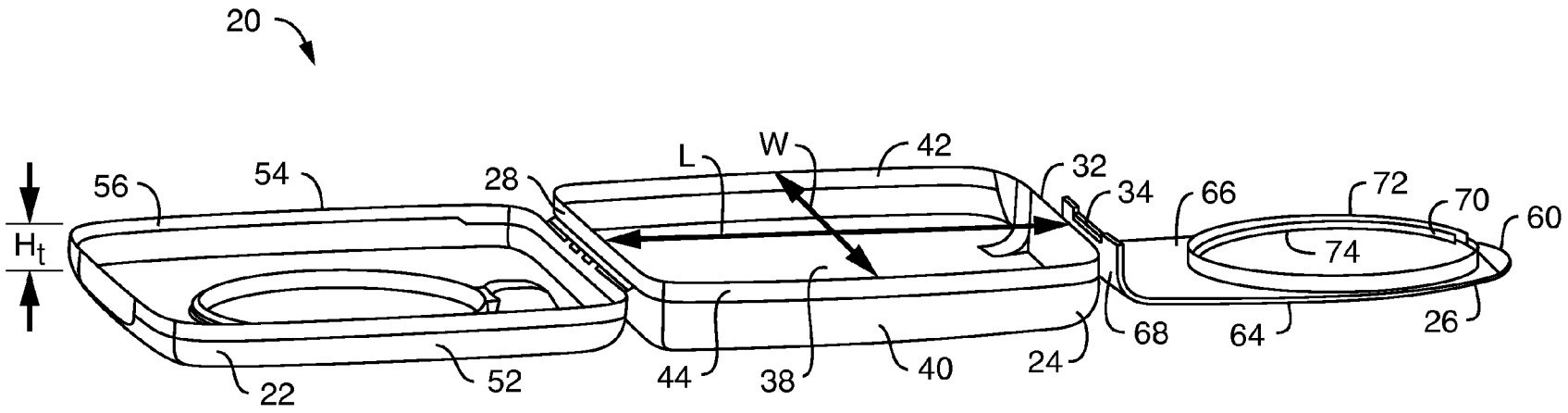
FIG. 3 illustrates a perspective view of one embodiment of a fully opened dispenser.

In one embodiment, the lid 26 or mini-lid 64 included an opening tab 60 located on the overlapping section 66 opposite the pivoting extension 68. The opening tab can be any convenient size or shape to assist in opening the lid 26. It can be located on any portion of the lid 26, but is desirably located on the overlapping section 66. Desirably the opening tab 60 has a downward turn or is lower in elevation with respect to the overlapping section 66 as best seen in FIG. 6. This protects the leading edge of the opening tab 60 since at least a portion of the opening tab is disposed in the opening recess 58 where it is much less likely to catch on the edge of a purse, pocket, or bag thereby inadvertently opening the mini-lid as best seen in FIG. 2.

The lid 26 or mini-lid 64 can further include a latching projection or latching recess 76 that mates with a locking projection or locking recess 78 on the top 22 to securely hold the lid 26 closed. For example, the lid 26 can have a latching projection and the top 22 a locking recess, or the lid 26 can have a latching recess and the top 22 a locking projection. Alternatively, the lid 26 and the top 22 can both have a projection such as two hooks or latches that mate with an interference that secures the lid 26 closed. To assist with opening the lid 26, at least a portion of the lid 26 or the top 22 is flexible such that when the opening tab 60 is engaged by a finger, the mechanism holding the lid 26 closed is more easily disengaged.

Figure 8:
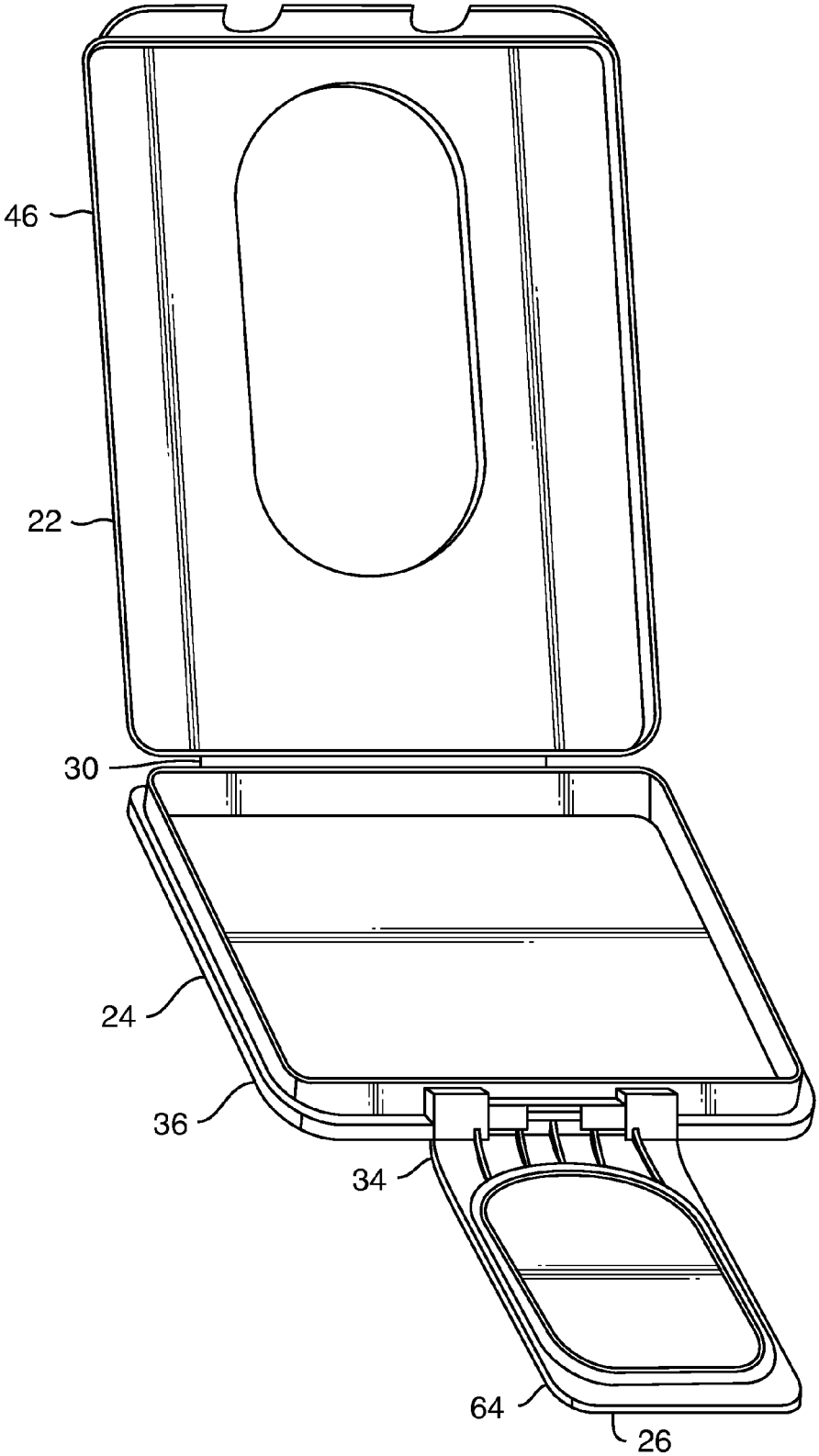
FIG. 8 illustrates a perspective view of an alternative embodiment of a fully opened dispenser.

The present invention in particular embodiments pertains to the manner in which the top 22 or the lid 26 are urged into particular resting positions to achieve various purposes. FIG. 8 representatively illustrates an alternative embodiment of a dispenser embodying principles of the present invention. The FIG. 9 group of figures representatively illustrates various views of a bottom 24, such as a tub 36. The FIG. 10 group of figures representatively illustrates various views of a top 22, such as a main lid 46. The FIG. 11 group of figures representatively illustrates various views of a lid 26, such as a dispensing lid or mini-lid 64.

Referring to FIGS. 8-14, the hinge 34 has an axis of rotation 101. The dispensing lid 64 is adapted to pivot about the axis of rotation 101. The dispensing lid 64 is adapted to assume a closed position 103 in which the interior 106 is sealed from the outside environment in an airtight manner. In the closed position 103, the dispensing lid 64 is restrained so as to be sealingly engaged with the main lid 46, such as via latching or locking mechanisms as previously described. The dispensing lid 64 is also adapted to assume a dispensing position 105, adapted to allow access to the interior 106 of the dispenser 20.

A user may at times attempt to move the lid 64 into a sealed and closed position 103, but may fail to actually snap or click the lid shut into the restrained condition. When this occurs, the lid is adapted in particular embodiments to "bound back" to a warning position 107. The warning position 107 is intended to warn a user that the dispensing lid 64 is not in the sealed and closed position 103. The warning position 107 should be angularly displaced from the closed position 103 by an amount large enough to attract the attention of the user so that the user is made aware that the lid 64 is not in fact closed. The user may then take more conscientious action to close the lid and properly snap or click it shut to the closed position 103. In particular embodiments, the warning position 107 is angularly displaced (with respect to the axis of rotation 101) by at least five degrees, preferably by at least five degrees but by at most 45 degrees, and more preferably by at least ten degrees but by at most 25 degrees, from the closed position 103. In particular embodiments, the dispenser 20 is configured such that the dispensing lid 64 is urged to the warning position 107 if the dispensing lid 64 is disposed in a red zone 108 that extends angularly between the closed position 103 and the warning position 107.

In particular embodiments, the hinge 34 includes a rod or pin 109, such as a rod or pin 109 that is integrally molded with either the tub 36 or the main lid 46. The hinge 34 further includes an open knuckle 111 integrally molded with the dispensing lid 64. The open knuckle 111 is in clamped engagement with the pin 109. The open knuckle 111 is comprised of two prongs 112, 112 generally forming a C-shape, and the two prongs 112, 112 are under outward radial pressure in at least certain angular positions of the knuckle 111 with respect to the pin 109. The pin 109 and the knuckle 111 are individually shaped to collectively urge the dispensing lid 64 from the red zone 108 to the warning position 107. Note that in particular embodiments, the hinge 34 can include only one pin and knuckle pair, or can include two or more pin and knuckle pairs. The hinge 34 of the embodiment of FIGS. 8-11 includes two pin and knuckle pairs.

For example, in the embodiment of FIGS. 8-14, each pin 109 defines an oval cross-section. The oval cross-section has a central longitudinal axis of symmetry 113. The knuckle 111 defines an inner profile 115 that extends around the axis of rotation 101. The inner profile 115 has a recess 117. If the dispensing lid is left in the red zone 108, the recess 117 is urged into angular alignment (with respect to the axis of rotation 101) with the longitudinal axis of symmetry 113 of the oval cross-section of the pin 109. In this embodiment, it is this angular alignment of the recess 117 and the longitudinal axis of symmetry 113 that defines the warning position 107. The hinge 34 is biased to assume this angularly aligned position in this embodiment because the recess 117 relieves some of the inward clamping pressure exerted by the prongs 112, 112 on the pin 109. FIGS. 9F, 12A, and 12B representatively show the longitudinal axis of symmetry 113 at a slight backwardly tipped angle relative to the main lid 146. If the lid 64 is not latched shut but is near the closed position 103 (FIG. 12A), the lid 64 is urged toward the warning position 107. When the recess 117 of the knuckle 111 is angularly aligned with the axis 113 (FIG. 12B), the lid 64 is held in the warning position 107. When the recess 117 of the knuckle 111 is angularly aligned with the axis 113, the portion of the pin 109 the proximal the recess 117 contacts with the inner profile 115 of the knuckle 111 simultaneously at the two nodes on either side of the deepest portion of the recess 117.

In other examples, the relative positions of the pin 109 and knuckle 111 are reversed, such that the pin 109 is integrally molded with the dispensing lid 64, and the open knuckle 11 is integrally molded with either the tub 36 or the main lid 46.

In particular embodiments, the pin 109 and the knuckle 111 are individually shaped to collectively urge the dispensing lid 64 to the dispensing position 105 when the dispensing lid 64 is angularly disposed within at least as much as 20 degree of the dispensing position 105, and more particularly within at least as much as 40 degrees of the dispensing position 105. In other words, as the dispensing lid 64 is opened by a user, the dispensing lid 64 is in particular embodiments configured to "snap open" to the dispensing position 105. "Dispensing position" means a position that provides a user with access to the wipes 80 through the dispensing orifice 50, unfettered by the dispensing lid 64. In particular embodiments, the dispensing position 105 is angularly displaced at least 90 degrees and more particularly by 180 degrees from the closed position 103. In particular embodiments, the dispensing position 105 of the lid 64 is a fully open position, past which the lid 64 will not pivot.

Note that the hinge configurations described above may also be employed on hinge 30, which connects the main lid 46 to the tub 36. In particular embodiments, the dispensing lid 64 is attached to the tub 36 at hinge 34. In other embodiments, the dispensing lid 64 is attached to the main lid 46 at a hinge (not shown).

Figure 9A:
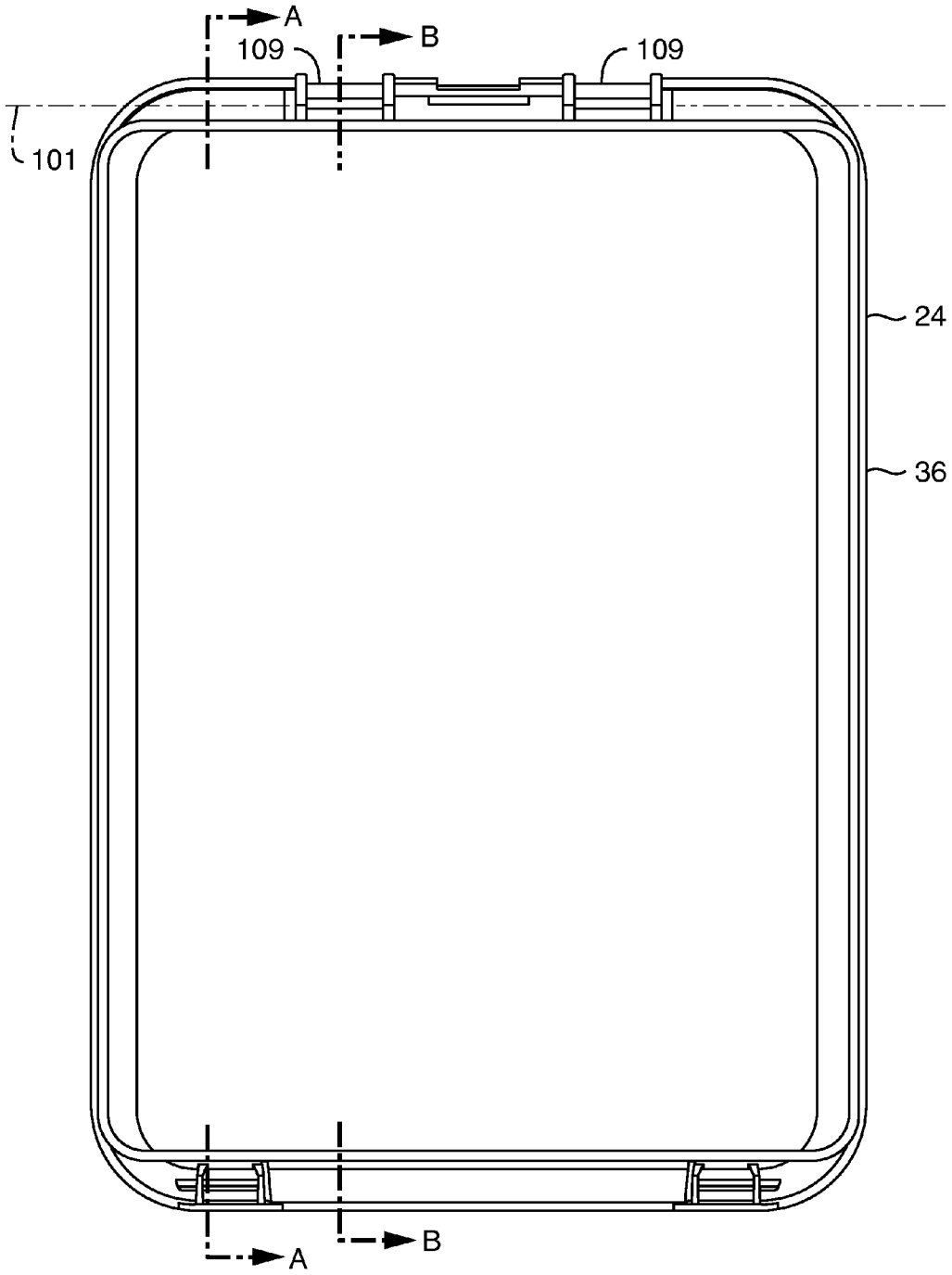
FIG. 9A illustrates an inner plan view of the tub of the dispenser of FIG. 8.
Figure 9B:
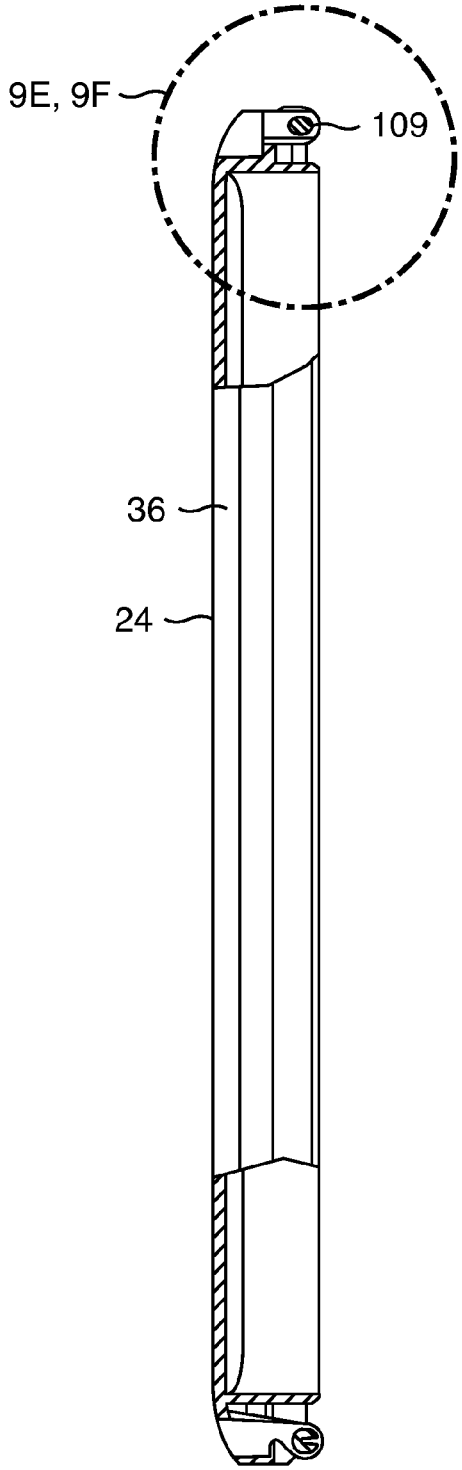
FIG. 9B illustrates a side view of the tub of FIG. 9A, with a first partial cross-sectional cutaway view taken along line A-A in FIG. 9A and a second partial cross-sectional cutaway view taken along line B-B in FIG. 9A.
Figure 9C:
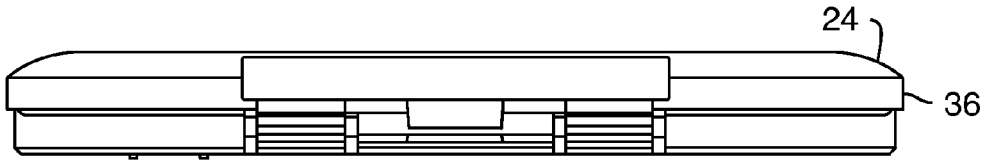
FIG. 9C illustrates an end view of the tub of FIG. 9A, taken from the end at which the dispenser lid attaches.
Figure 9D:
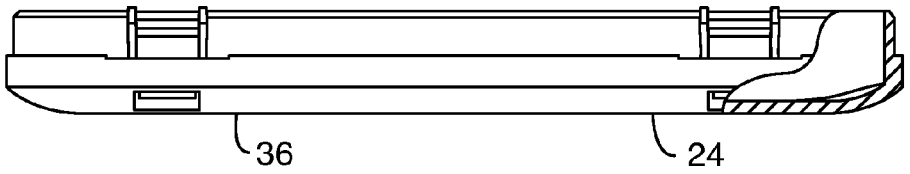
FIG. 9D illustrates an end view of the tub of FIG. 9A, taken from the end at which the main lid attaches.
Figure 9E:
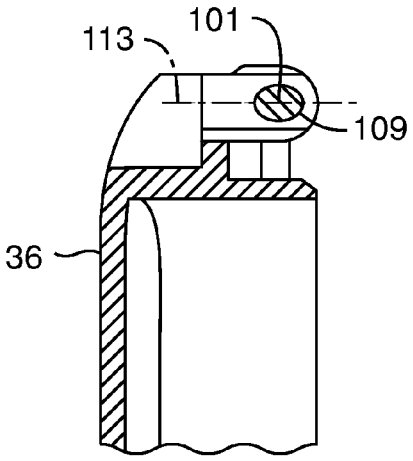
FIG. 9E illustrates a detail view of the area labeled "9E" in FIG. 9B.
Figure 9F:
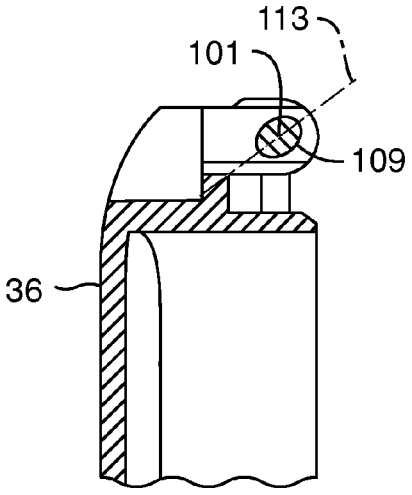
FIG. 9F illustrates an alternative embodiment of the detail area labeled "9E" in FIG. 9B.
Figure 10A:
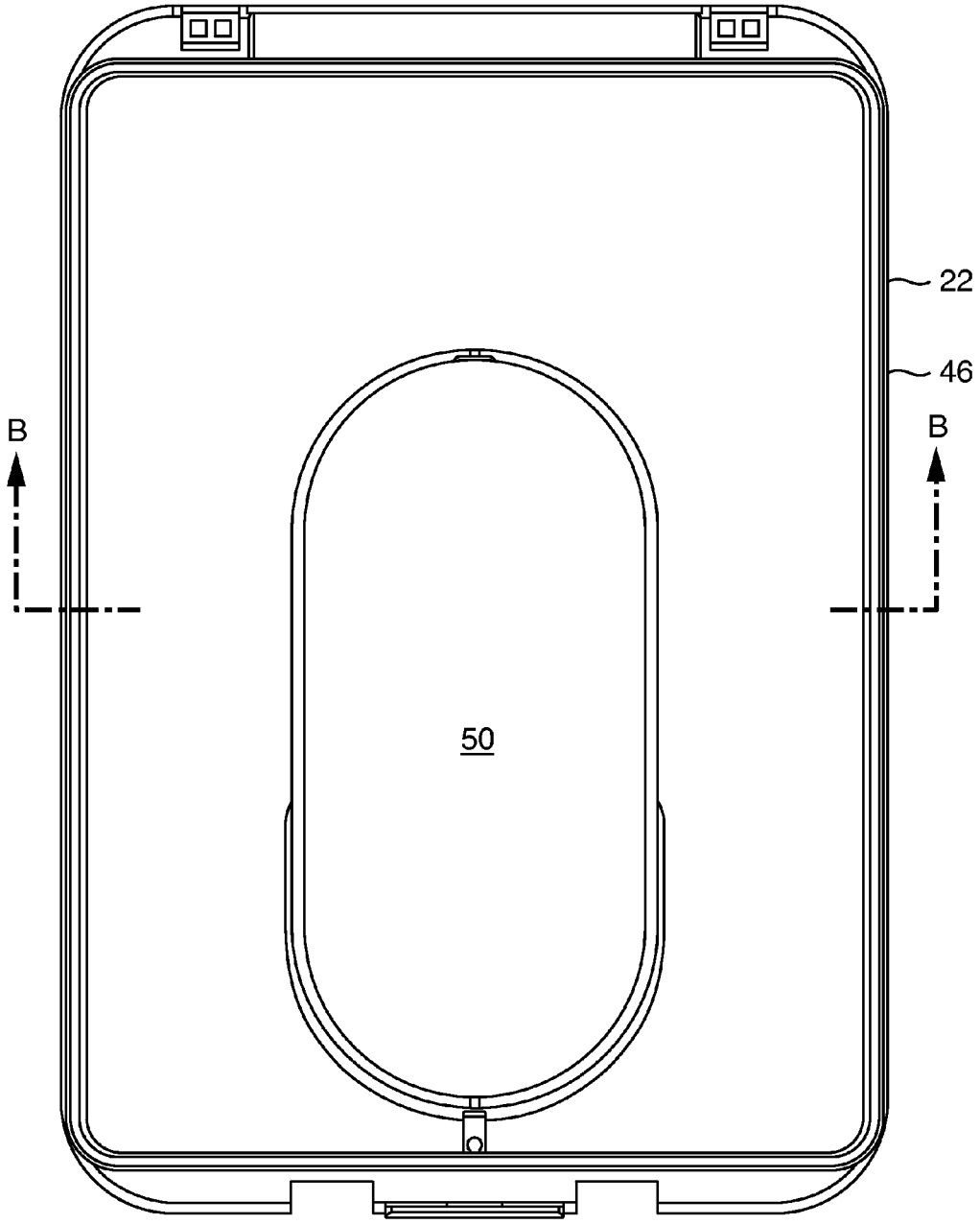
FIG. 10A illustrates an inner plan view of the main lid of the dispenser of FIG. 8.
Figure 10B:
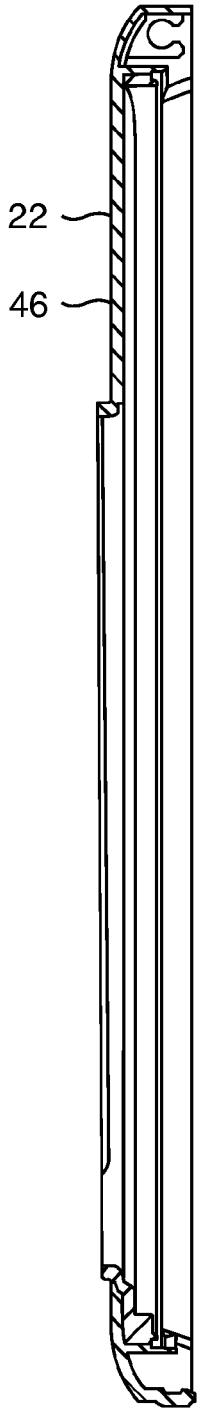
FIG. 10B illustrates a cross-sectional view of the main lid of FIG. 10A taken along line A-A in FIG. 10C.
Figure 10C:
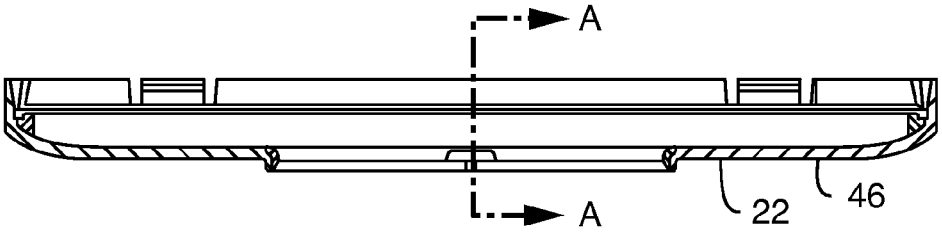
FIG. 10C illustrates a cross-sectional view of the main lid of FIG. 10A taken along line B-B in FIG. 10C.
Figure 10D:
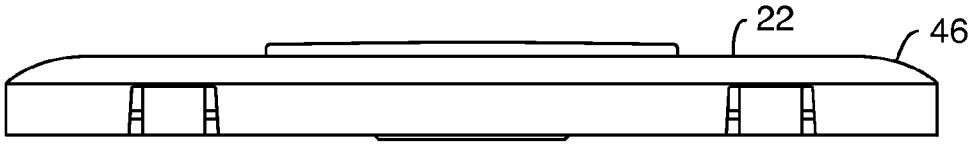
FIG. 10D illustrates an end view of the main lid of FIG. 10A taken from the end at which the main lid attaches to the tub.
Figure 11A:
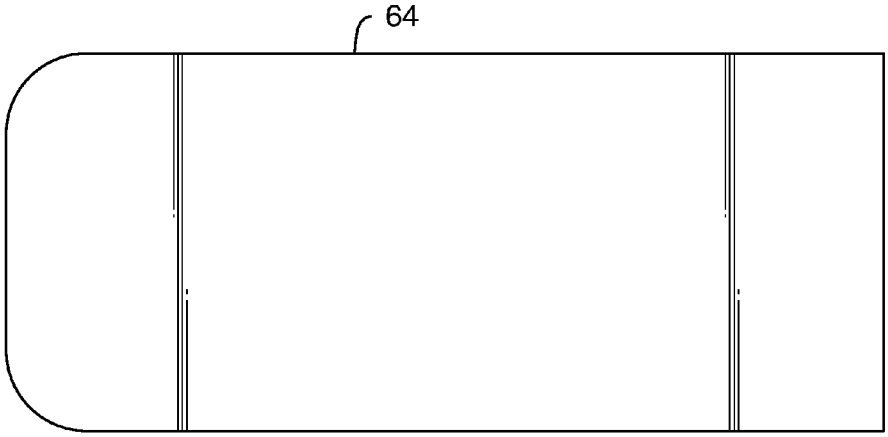
FIG. 11A illustrates an outer plan view of the dispensing lid of the dispenser of FIG. 8.
Figure 11B:
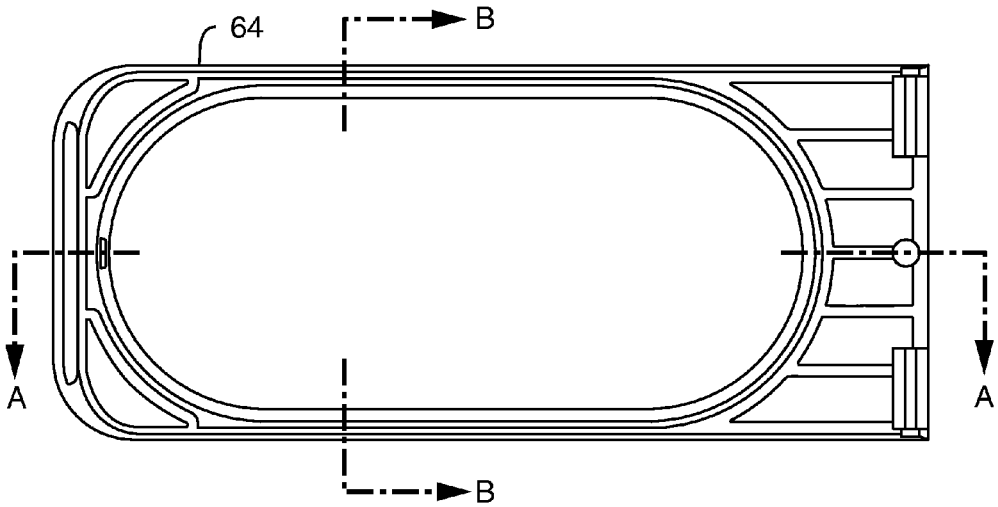
FIG. 11B illustrates an inner plan view of the dispensing lid of the dispenser of FIG. 8.
Figure 11C:
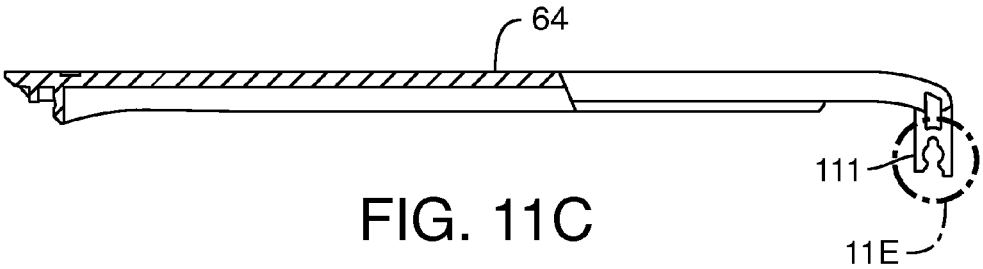
FIG. 11C illustrates a side view of the dispensing lid of FIG. 11B, with a partial cross-sectional cutaway view taken along line A-A in FIG. 11B.
Figure 11D:
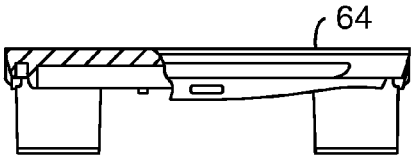
FIG. 11D illustrates an end view of the dispensing lid of FIG. 11B, with a partial cross-sectional cutaway view taken along line B-B in FIG. 11B.
Figure 11E:
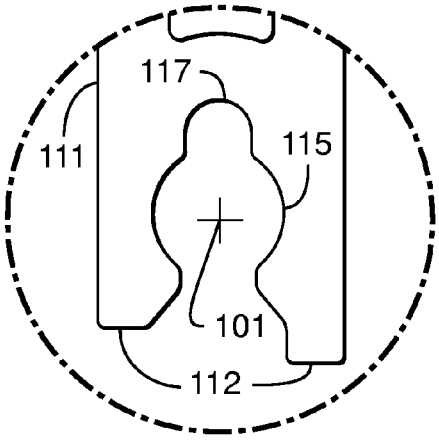
FIG. 11E illustrates a detail view of the area labeled "11E" in FIG. 11C.
Figure 12A:
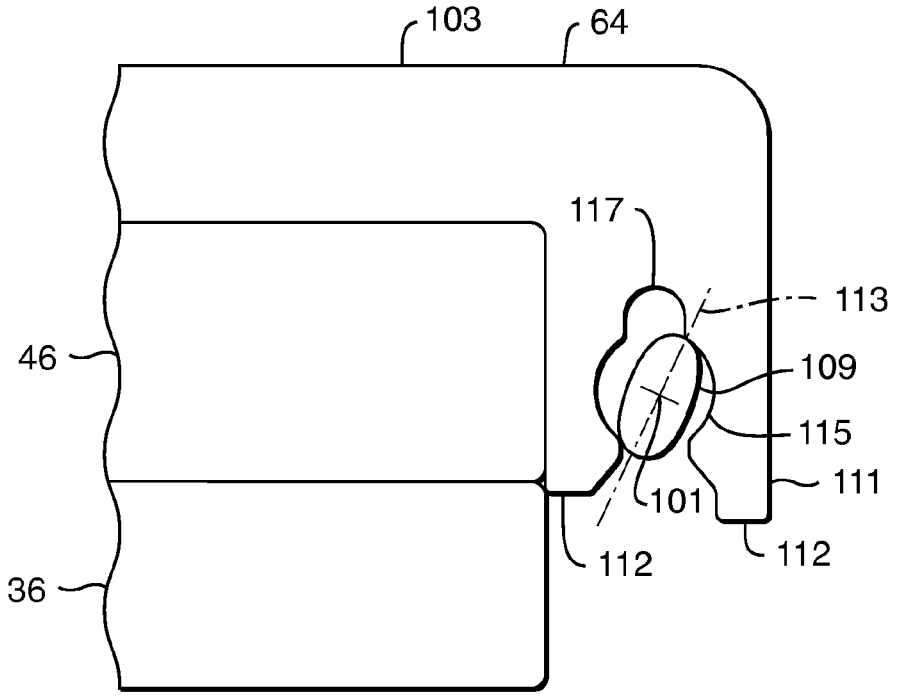
FIG. 12A illustrates a detail view of the hinge 34 of the dispenser of FIG. 8, wherein the lid 64 is in a closed position, the view being a cross-sectional view taken at a position akin to the one defined by line B-B in FIG. 9A.
Figure 12B:
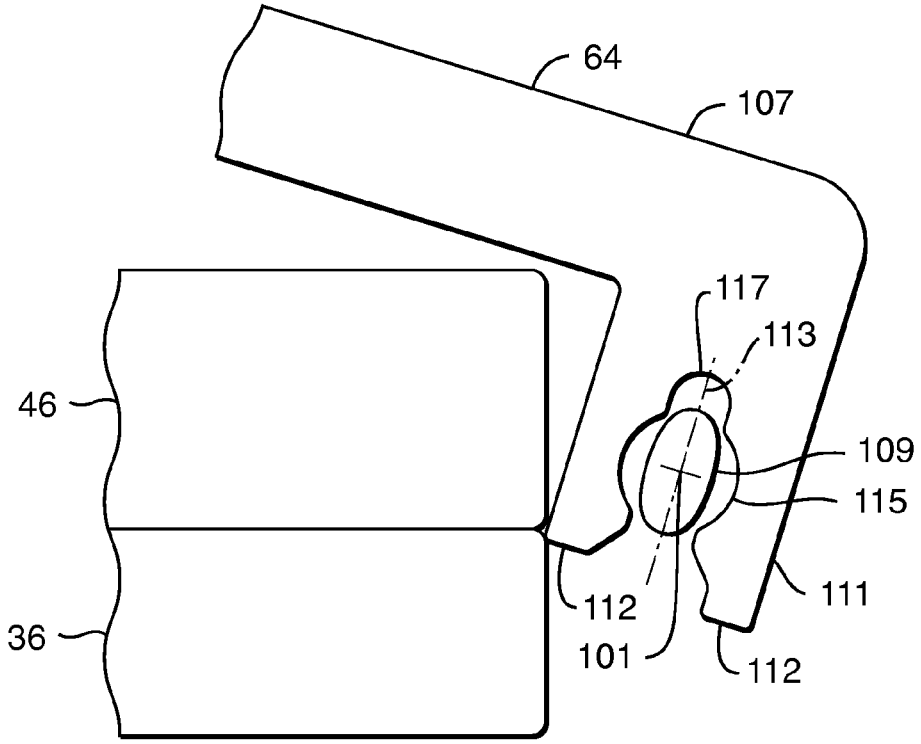
FIG. 12B illustrates a detail view of the hinge 3 of the dispenser of FIG. 8, wherein the lid 64 is in a warning position, the view being a cross-sectional view taken at a position akin to the one defined by line B-B in FIG. 9A.
Figure 13A:
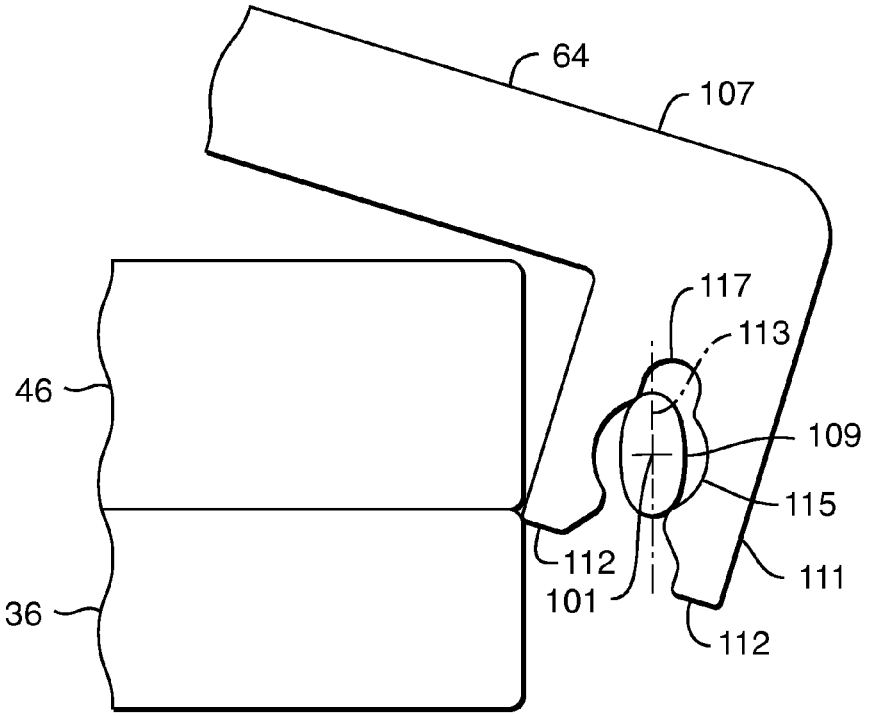
FIG. 13A illustrates an alternative configuration of the hinge shown in FIG. 12A.
Figure 13B:
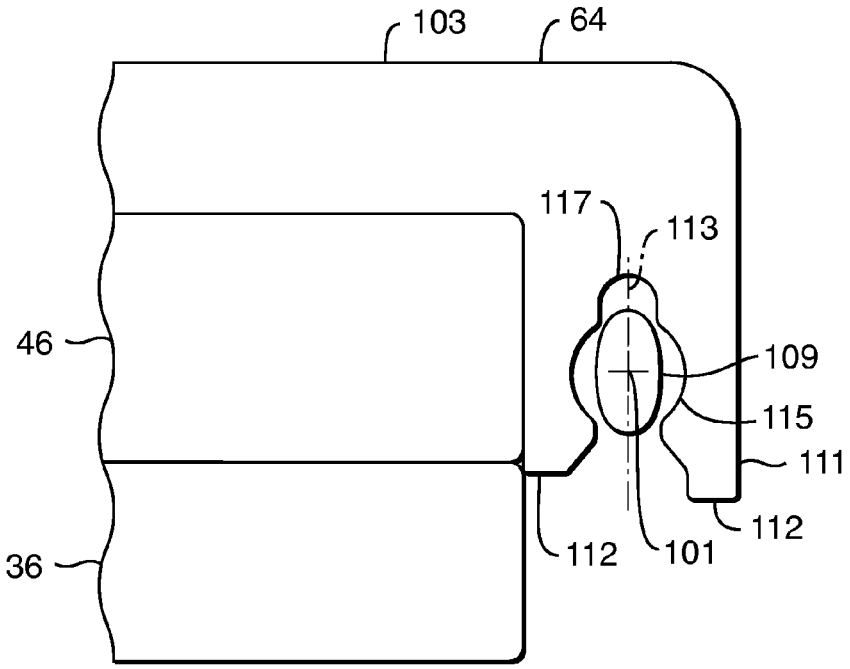
FIG. 13B illustrates an alternative configuration of the hinge shown in FIG. 12B.
Figure 14:
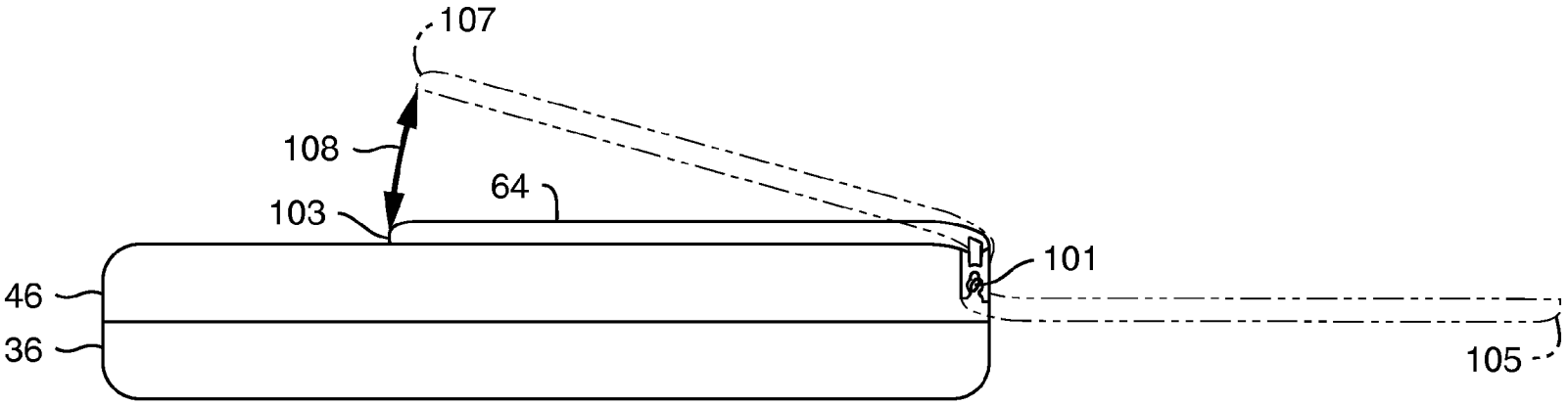
FIG. 14 illustrates a side view of the dispenser of FIG. 8, showing additional angular positions of the dispensing lid in phantom lines.

In an alternative embodiment, the pin 109 and the knuckle 111 are individually shaped to collectively urge the dispensing lid toward the closed position 103 when the top is angularly displaced from the closed position 103 by as much as 10 degrees, more particularly by as much as 20 degrees, and still more particularly by as much as 30 degrees. In other words, as the dispensing lid 64 is moved towards the closed position 103 by a user, the dispensing lid 64 is in particular embodiments configured to "snap shut" toward the closed position 103. Also, as described earlier, the pin 109 and the knuckle 111 can be individually shaped to collectively urge the dispensing lid 64 toward a fully open dispensing position 105 when the dispensing lid 64 is angularly displaced from the dispensing position 105 by as much as 20 degrees. For example, the recess 117 can be urged into a first angular alignment with the longitudinal axis of symmetry 113 of the oval cross-section of the pin 109 when the dispensing lid 64 is in the closed position 103, and the recess 117 can also be urged into a second angular alignment with the longitudinal axis of symmetry 113 of the oval cross-section when the dispensing lid 64 is in the dispensing position 105, such that the first angular alignment is angularly displaced from the second angular alignment by at least 160 degrees, and preferably by approximately 180 degrees. The hinge 34 is biased to assume these angularly aligned positions in this embodiment because the recess 117 relieves some of the inward clamping pressure exerted by the prongs 112, 112 on the pin 109. FIGS. 9E, 13A, and 13B representatively show the longitudinal axis of symmetry 113 at a right angle relative to the main lid 146. If the lid 64 is near but not quite at the closed position 103 (FIG. 13A), the lid 64 is urged toward the closed position 103. When the recess 117 of the knuckle 111 is angularly aligned with the axis 113 (FIG. 13B), the lid 64 is held in the closed position 103.

Figure 7:
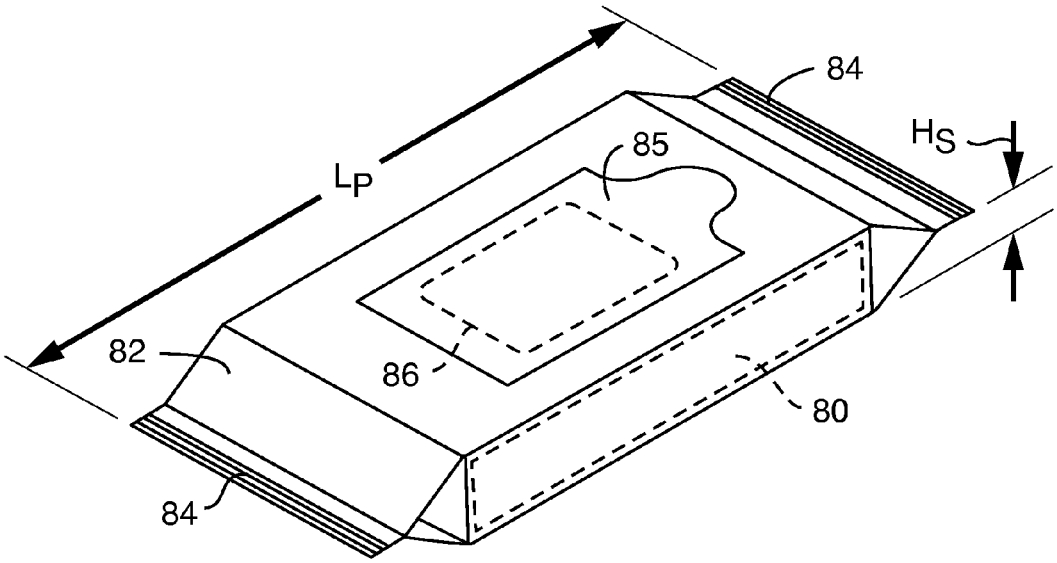
FIG. 7 illustrates a refill pouch housing a plurality of wet wipes.

Referring now to FIG. 7, a plurality of wet wipes 80 are in particular embodiments disposed in a flexible pouch 82 having at least one seal 84 or opposing seals 84 located on either end of the pouch. The pouch 82 includes a removable label 85 that can help to retain the moisture of the wet wipes during shipping. The label 85 can be removably attached to the pouch 82 by an adhesive. The label 85 is removed to expose a dispensing opening 86 for dispensing the wet wipes 80. The flexible pouch has a seal height, Hs, of the at least one seal 84 as shown. In one embodiment, the bottom 24 of the dispenser 20 has a height, Hb, that is greater than the seal height Hs. The bottom 24 can also have an overall width, W, or length, L, that is less than the overall seal length, Lp, of the flexible pouch 82 measured between the opposing sealed ends or measured from one side of the flexible pouch 82 to the end of the at least one seal 84. The seals 84 can be located on both ends, both sides, on just one side, or on all four sides. Alternatively, the wipes 80 can be removed from a flexible pouch entirely before being placed in the dispenser for dispensing.

By dimensioning the bottom 24 in this manner, the seals 84 of the pouch can be folded up (or down) adjacent to the upstanding sidewall 40 of the tub and out of the way from the upper edge 42 where they could prevent closing of the top 22 when the pouch 82 is inserted into the dispenser 20. Additionally, by having one or more seals 84 fold upwards (or downwards) and exert pressure on the upstanding sidewall 40, the pouch 82 is partially restrained from moving or sliding around within the dispenser's interior.

In an alternative embodiment of the dispenser, the dispensing orifice 50 in the upper surface 48 can be eliminated. In this embodiment, the lid 26 still locks or latches with the top and at least partially overlaps the top, but the dispenser 20 is intended for reach-in dispensing. To use the dispenser, the lid 26 must be opened and then the top 22 opened to access the dispenser's interior 106. Since the top 22 can be restrained by the lid 26 and a snap fit with the bottom 24, the dispenser is less likely to open inadvertently if accidentally dropped.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A moist wipes dispenser comprising a top attached to a bottom along a hinge, the hinge having an axis of rotation, the top adapted to pivot about the axis of rotation, wherein the top is adapted to assume a substantially vapor-impervious closed position, a dispensing position adapted to allow access to an interior of the dispenser, and a warning position adapted to warn a user that the top is not in the closed position, wherein the warning position is angularly displaced from the closed position by at least five degrees, wherein in the closed position, the top is restrained so as to be sealingly engaged with the bottom, wherein a force must be applied to the top by a user to urge the top to the closed position, the dispenser being configured such that the top is urged to the warning position if the top is angularly disposed in a red zone that extends between the closed position and the warning position.

2. The dispenser of claim 1, wherein the warning position is angularly displaced from the closed position by at least five degrees and by at most 45 degrees.

3. The dispenser of claim 1, wherein the warning position is angularly displaced from the closed position by at least 10 degrees and by at most 25 degrees.

4. The dispenser of claim 1, wherein the hinge comprises a pin integrally molded with one of the top and bottom, and further comprises an open knuckle integrally molded to the other of the top and bottom, the open knuckle being in clamped engagement with the pin, wherein the pin and the knuckle are shaped to collectively urge the top from the red zone to the warning position.

5. The dispenser of claim 4, wherein the pin defines an oval cross-section, the oval cross-section having a central longitudinal axis of symmetry, wherein the knuckle defines an inner profile that extends around said axis of rotation, the inner profile having a recess, wherein said recess is urged into angular alignment with said longitudinal axis of symmetry of said oval cross-section when the top is in the red zone, said angular alignment defining the warning position.

6. The dispenser of claim 4, wherein the pin and the knuckle are shaped to collectively urge the top to the dispensing position when the top is angularly disposed within 20 degrees of the dispensing position.

7. The dispenser of claim 4, wherein the pin is integrally molded to the bottom.

8. The dispenser of claim 1, wherein the top is restrained in sealing engagement with the bottom via a latch.

9. A moist wipes dispenser comprising a tub, a main lid, and a dispensing lid, the main lid attached to the tub along a first hinge, the dispensing lid attached to either the tub or the main lid along a second hinge, the second hinge having an axis of rotation, the dispensing lid adapted to pivot about the axis of rotation, wherein the dispensing lid is adapted to assume a substantially vapor-impervious closed position, a dispensing position adapted to allow access to an interior of the dispenser, and a warning position adapted to warn a user that the top is not in the closed position, wherein the warning position is angularly displaced from the closed position by at least five degrees, wherein in the closed position, the dispensing lid is restrained so as to be sealingly engaged with the main lid, wherein a force must be applied to the dispensing lid by a user to urge the dispensing lid to the closed position, the dispenser being configured such that the dispensing lid is urged to the warning position if the dispensing lid is disposed in a red zone that extends angularly between the closed position and the warning position.

10. The dispenser of claim 9, wherein the warning position is angularly displaced from the closed position by at least five degrees and by at most 45 degrees.

11. The dispenser of claim 9, wherein the warning position is angularly displaced from the closed position by at least 10 degrees and by at most 25 degrees.

12. The dispenser of claim 9, wherein the second hinge comprises a pin integrally molded with either the tub or the main lid, and further comprises an open knuckle integrally molded with the dispensing lid, the open knuckle being in clamped engagement with the pin, wherein the pin and the knuckle are shaped to collectively urge the dispensing lid from the red zone to the warning position.

13. The dispenser of claim 12, wherein the pin defines an oval cross-section, the oval cross-section having a central longitudinal axis of symmetry, wherein the knuckle defines an inner profile that extends around said axis of rotation, the inner profile having a recess, wherein said recess is urged into angular alignment with said longitudinal axis of symmetry of said oval cross-section when the dispensing lid is in the red zone, said angular alignment defining the warning position.

14. The dispenser of claim 12, wherein the pin and the knuckle are shaped to collectively urge the dispensing lid to the dispensing position when the dispensing lid is angularly disposed within 20 degrees of the dispensing position.

15. The dispenser of claim 9, wherein the second hinge comprises a pin integrally molded with the dispensing lid, and further comprises an open knuckle integrally molded with either the tub or the main lid, the open knuckle being in clamped engagement with the pin, wherein the pin and the knuckle are shaped to collectively urge the dispensing lid from the red zone to the warning position.

16. The dispenser of claim 15, wherein the pin defines an oval cross-section, the oval cross-section having a central longitudinal axis of symmetry, wherein the knuckle defines an inner profile that extends around said axis of rotation, the inner profile having a recess, wherein said recess is urged into angular alignment with said longitudinal axis of symmetry of said oval cross-section when the dispensing lid is in the red zone, said angular alignment defining the warning position.

17. The dispenser of claim 9, wherein the top is restrained in sealing engagement with the bottom via a latch.

18. A moist wipes dispenser comprising a top attached to a bottom along a hinge, the hinge having an axis of rotation, the top adapted to pivot about the axis of rotation, wherein the top is adapted to assume a substantially vapor-impervious closed position and a dispensing position that is adapted to allow access to an interior of the dispenser, wherein in the closed position, the top is sealingly engaged with the bottom, wherein the hinge comprises a pin integrally molded with one of the top and bottom, and further comprises an open knuckle integrally molded to the other of the top and bottom, the open knuckle being in clamped engagement with the pin, wherein the pin and the knuckle are shaped to collectively urge the top (1) toward the closed position when the top is angularly displaced from the closed position by as much as 20 degrees; and (2) toward the dispensing position when the top is angularly displaced from the dispensing position by as much as 20 degrees.

19. The dispenser of claim 18, wherein the pin defines an oval cross-section, the oval cross-section having a central longitudinal axis of symmetry, wherein the knuckle defines an inner profile that extends around said axis of rotation, the inner profile having a recess, wherein said recess is urged into a first angular alignment with said longitudinal axis of symmetry of said oval cross-section when the top is in the closed position, and wherein said recess is urged into a second angular alignment with said longitudinal axis of symmetry of said oval cross-section when the top is in the dispensing position, said first angular alignment being angularly displaced from said second angular alignment by at least 160 degrees.

20. The dispenser of claim 18, wherein the top comprises a dispensing lid and wherein the bottom comprises a main lid attached to a tub.

* * * * *